United States Patent [19]

DiPasquale et al.

[11] Patent Number: 4,460,152

[45] Date of Patent: Jul. 17, 1984

[54] HAND PUMP WITH AUTOMATIC LOCK-OUT

[75] Inventors: David A. DiPasquale, Lynchburg; James J. Hammer, Forest, both of Va.

[73] Assignee: Philadelphia Gear Corporation, King of Prussia, Pa.

[21] Appl. No.: 450,100

[22] Filed: Dec. 15, 1982

[51] Int. Cl.[3] ..... F16D 31/02; F16K 31/12

[52] U.S. Cl. ..... 251/26; 60/400; 60/402; 417/425; 417/507

[58] Field of Search ..... 417/288, 507, 425; 60/400, 402; 251/26

[56] References Cited

U.S. PATENT DOCUMENTS 3,069,855 12/1962 Denkowski et al. ..... 60/400

4,120,478 10/1978 Hasegawa ..... 251/26

*Primary Examiner*—Richard E. Gluck

*Attorney, Agent, or Firm*—Paul & Paul

[57] ABSTRACT

In a system for opening and closing a main line valve by use of high pressure hydraulic fluid which is controlled from a remote location and in which the fluid passes through a hand pump located at the site of the valve, a protective lock-out system is provided for guarding against personal injury in the event the high pressure fluid should arrive at the hand pump while it is being manually operated. The lock-out system includes a small piston located in an air passageway which is positioned outwardly of the hand pump main piston chamber. This passageway extends from the top of the hand pump main piston chamber toward the IN port which receives the high pressure hydraulic fluid. The piston is connected by a shaft to a poppet valve. The high pressure fluid is applied to the under-surface of the piston and to the seat side of the poppet valve. On the up stroke of the hand pump, the lock-out piston is forced downwardly by the increase in air pressure on the top surface of the piston which exceeds the differential hydraulic pressure applied to the underside of the lock-out piston thereby slightly opening the poppet valve and allowing a limited amount of pressure to be applied to the lower chamber of the hand pump piston.

12 Claims, 6 Drawing Figures

HAND PUMP WITH AUTOMATIC LOCK-OUT

BACKGROUND OF THE INVENTION

This invention relates to valve actuators and in particular to valve actuators which are operable by remote control by high pressure gas and/or high pressure hydraulic fluid.

Valve actuators of the foregoing type are almost always provided with a hand pump which is manually operable by the maintenance man at the site of the valve. Such hand pump is also connected in series with a high pressure line for remote-control operation. If the high pressure fluid from the remote location arrives at the site of the hand operation at the time that the maintenance man is using the hand pump to open or close the valve, there is danger of personal injury to the maintenance man, due to the handpump handle being forced upward by the high pressure fluid.

SUMMARY OF THE INVENTION

A principal object of the present invention is to provide a specially designed manually operable pump which will prevent personal injury to the maintenance mean if high pressure fluid from the remote-control system arrives at the hand pump while it is being operated by the maintenance man.

The foregoing object is achieved by providing the hand pump with an automatic lock-out device which, in response to the high pressure, closes a passageway and prevents the high pressure hydraulic fluid from reaching the lower cavity of the hand-pump piston.

BRIEF DESCRIPTION OF THE DRAWINGS

FIG. 6 will be helpful in explaining the operation and purpose of the new hand pump.

DETAILED DESCRIPTION OF THE PREFERRED EMBODIMENTS

Figure 6:
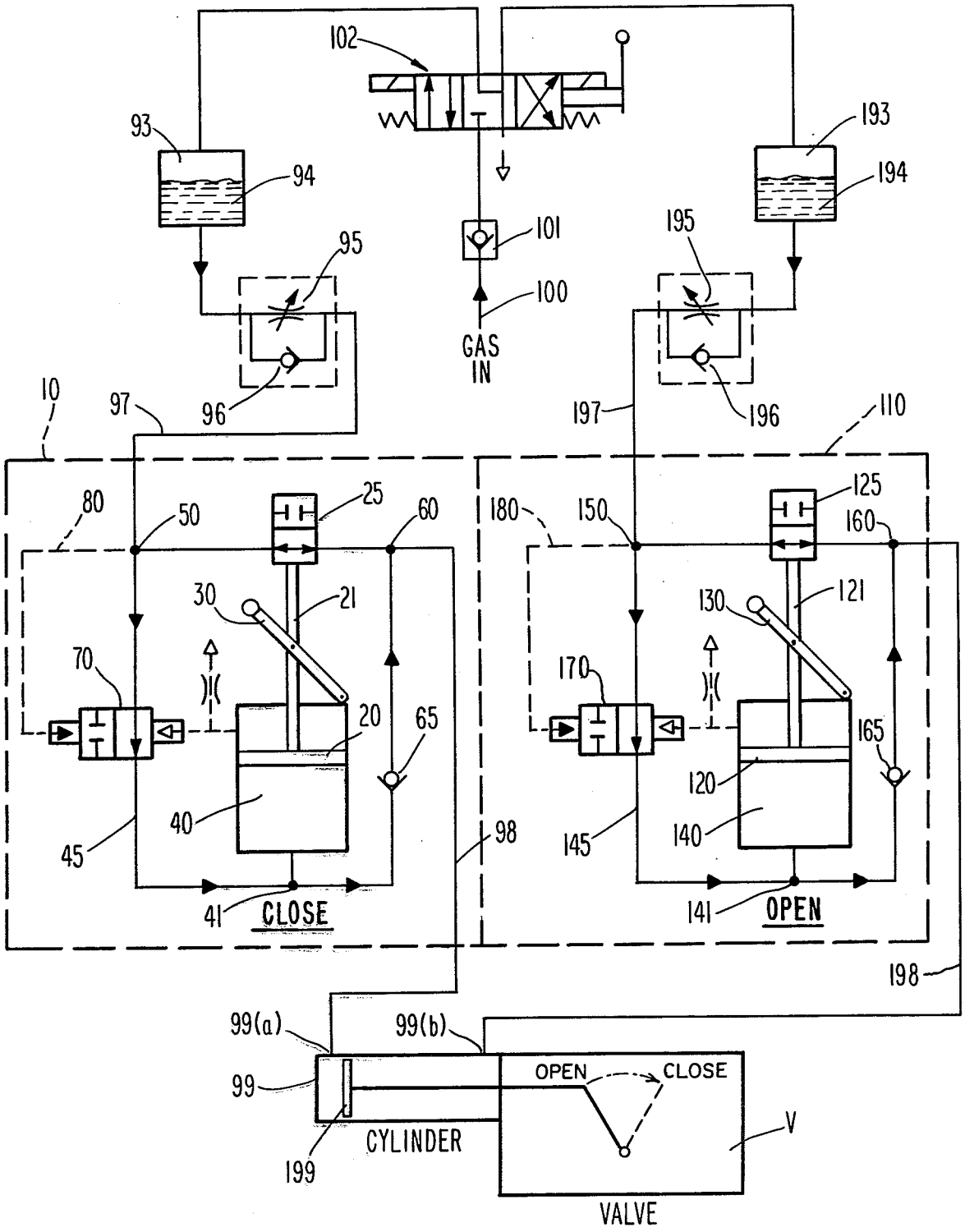
FIG. 6 is a schematic diagram which shows the entire remote-control system in which the dual hand pump is used.

Reference will first be made to FIG. 6 which illustrates diagrammatically the use of two hand pumps 10 and 110 which are operable manually using low pressure hydraulic fluid from tanks 94 and 194, and through which high pressure hydraulic fluid flows when high pressure gas is applied to the gas tanks 93 or 193.

In FIG. 6, a first pump 10 is shown on the left side of the drawing and a second pump 110 is shown on the right side. As indicated in FIG. 6, the left pump 10 is used for closing the main valve V and the right pump 110 is used for opening the main valve V.

When solenoid valve 102 is in the center position indicated in FIG. 6, no high pressure gas from source 100 reaches the gas tanks 93 or 193, and only low pressure hydraulic fluid (preferably oil) from tanks 94 or 194 is applied to the IN port 50 or 150 of the pumps 10 or 110.

In low pressure operation, when pump handle 30 of left pump 10 is pulled down by the maintenance man, the piston 20 forces the low-pressure fluid, which had entered the lower chamber 40, out through port 41, up through a check valve 65, and out the OUT port 60 which leads by way of conduit 98 to the left port 99(*a*) of piston cylinder 99, thereby causing piston 199 of the cylinder to move to the right, and thereby changing the main valve from open to closed position.

To return the main valve V from closed to open position, the right pump 110 is used. On the down stroke of piston 120, hydraulic fluid in the lower chamber 140 is forced out through port 141, through check valve 165, out the OUT port 160 and through conduit 198 to the right port 99(*b*) of cylinder 99, thereby moving piston 199 from right to left, and thereby changing the main valve V from closed to open position.

Although the manual operation will be described in detail later on in connection with FIGS. 1–5, it should be mentioned here that, in FIG. 6, when pump handle 30 is pulled down, the interconnection 25 between IN port 50 and OUT port 60 is blocked.

Also, on the down stroke of the piston 20, the interconnection 70 is blocked. As a result, the fluid is forced by the downward moving piston 20 out of port 41 and is prevented from returning by way of passageways 45 and 80 to the IN port 50. It should also be mentioned that at the end of a manual pumping operation the piston is always left in its upmost position.

So far we have been discussing the manual operation of the hand pumps 10 and 110 using very low pressure oil from tanks 94 or 194.

Assume now that, with both hand pumps in the upmost position and neither pump being operated manually, an electric signal is applied to the solenoid valve 102 to cause the valve to shift from center to right. High-pressure gas from source 100 will then pass through valve 102 and into the gas tank 93 of the gas-oil tank 93–94. Here the high gas pressure converts the low pressure fluid in tank 94 to high hydraulic pressure. This pressure is applied through valve 95 and conduit 97 to IN port 50. With piston 20 in its upmost position, there is a direct connection at 25 between IN port 50 and OUT port 60. Thus, the high fluid pressure is applied by way of conduit 98 to the left port 99(*a*) of the piston cylinder 99, thereby moving the piston 199 from left to right and thereby changing the main valve V from open to closed position.

To change the main valve V from closed to open position, the solenoid valve 102 is shifted from right to left. This applies high pressure gas to the gas tank of gas-oil tank 193–194. High pressure oil is now applied to IN port 150 of hand pump 110. This pressure is applied through connection 125 to OUT port 160 and then by way of conduit 198 to right port 99(*b*) of piston cylinder 99, thereby moving piston 199 from right to left and changing valve V from closed to open position.

In prior art arrangements for opening and closing the main valve from a remote location using high pressure hydraulic fluids, and having a hand pump built into the system, it was possible, during manual operation of the hand pump by the maintenance man, for high pressure hydraulic fluid to be applied to the base of the piston while it was moving downwardly. This would abruptly stop and reverse the direction of the piston, and there was a distinct possiblity of injury occuring to the hand, arm, or other part of the body of the maintenance man. The possibility of this happening is avoided when the automatic lock-out device of the present invention is incorporated into the hand pump.

Figure 1:
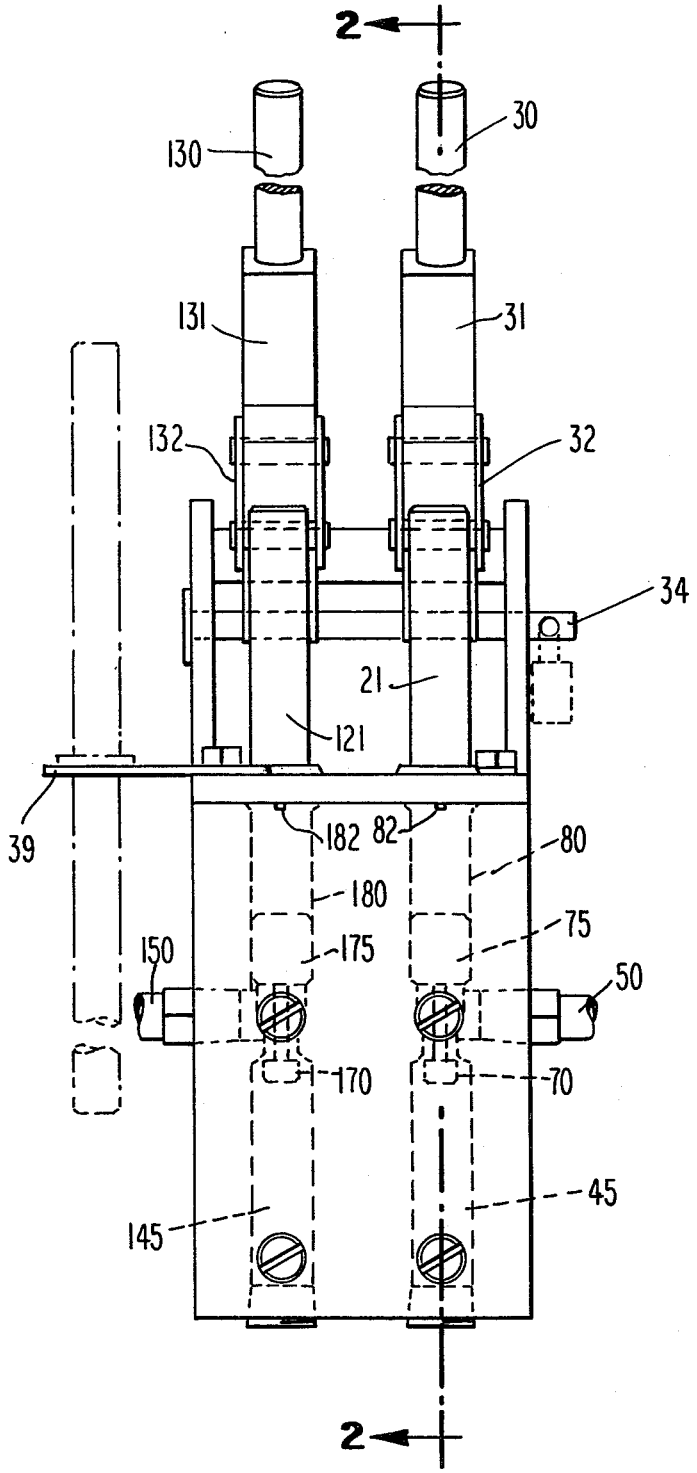
FIG. 1 is an elevational view of a dual hand pump according to the present invention.

Reference is now made to FIG. 1 which shows two identical hand pumps 10 and 110 in side-by-side relation. Pump 10, which is used to close the main valve is shown on the right. Pump 110, which is used to open the main valve, is shown on the left.

Figure 2:
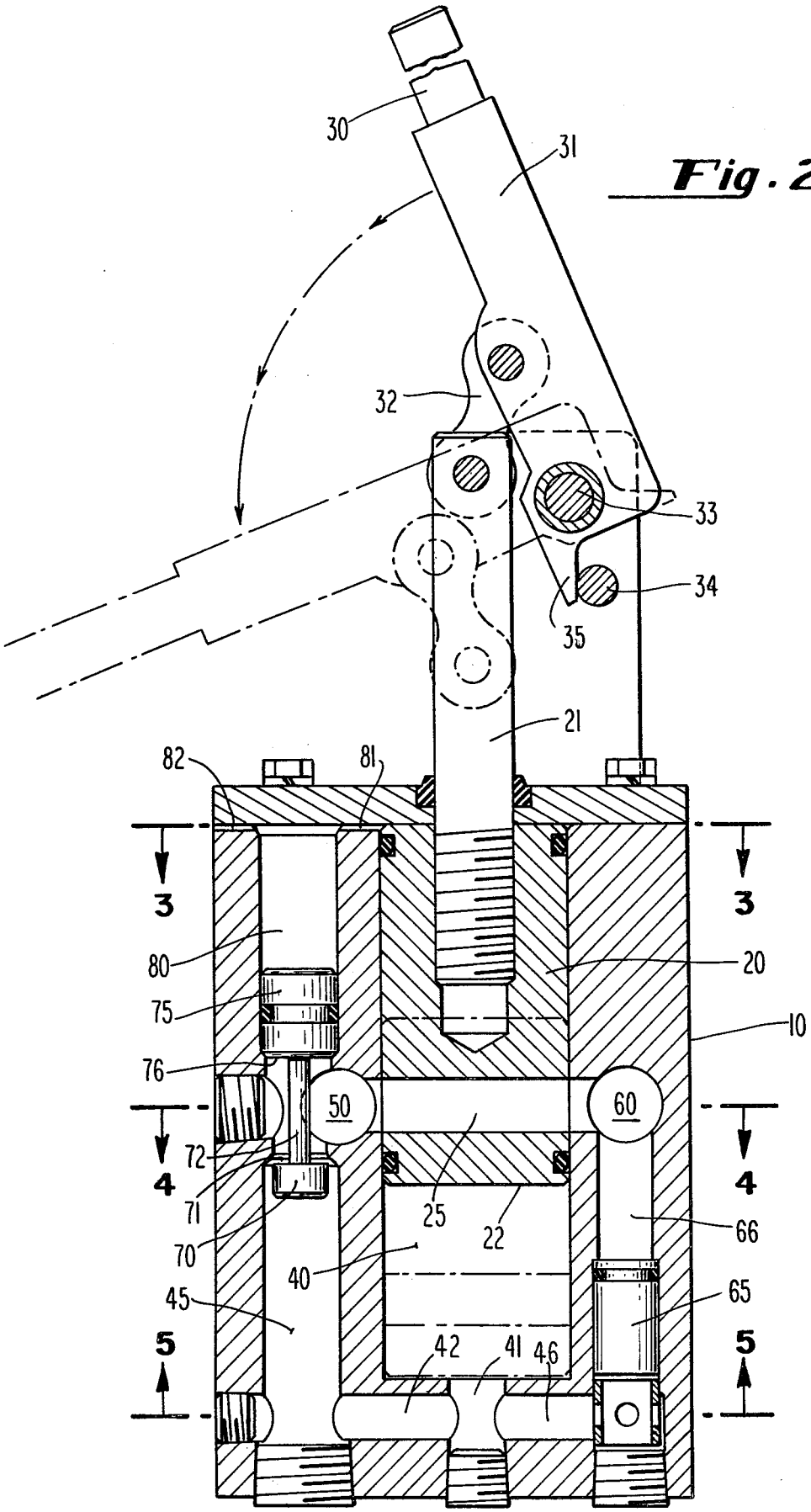
FIG. 2 is a view, in section, looking along the line 2—2 of FIG. 1.

FIG. 2 is a view, in section, looking along the line 2—2 of FIG. 1. Accordingly, the pump body shown in FIG. 2 corresponds to pump 10 shown diagramatically on the left side of FIG. 6.

Referring now to FIG. 2, the manual operation of pump 10 will now be described. The solenoid valve 102 in FIG. 6 is in the blocking position shown in FIG. 6 and, accordingly, the hydraulic fluid at IN port 50 is under very low pressure, perhaps one p.s.i. or so. The piston 20 of pump 10 is manually operable by means of a pump handle 30 which, when the maintenance man wants to operate the pump, is taken out of its bracket 39, seen in FIG. 1, and placed in sheath 31. Sheath 31 is connected by a link 32 to the shaft 21 of piston 20 and is pivotal about a pivot pin 33. A stop bar 34 is adapted to be engaged by a projection 35 on the sheath 31. This keeps the piston 20 in the upright position when not in use.

Figure 3:
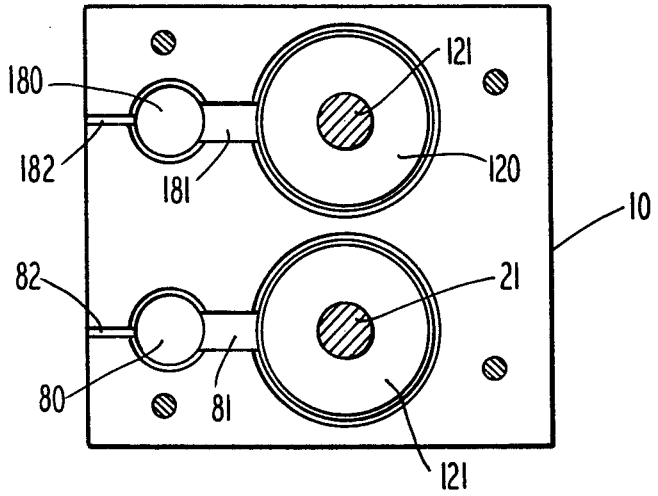
FIG. 3 is a view looking down along the line 3—3 of FIG. 2.
Figure 4:
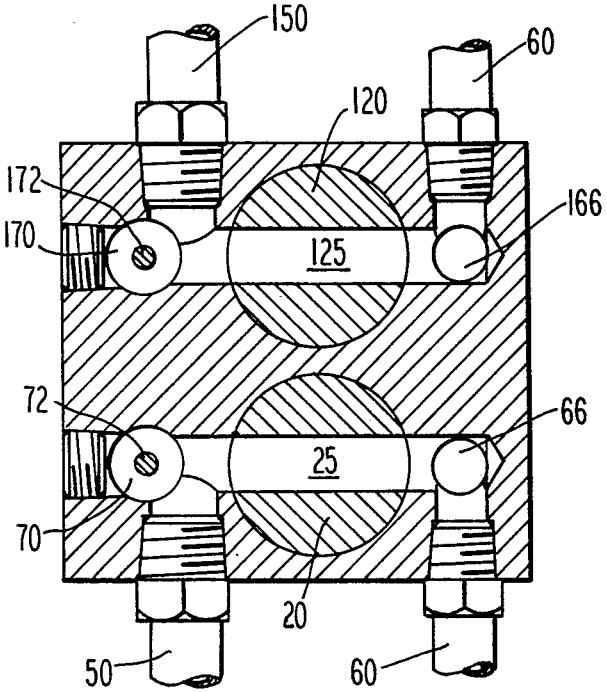
FIG. 4 is a view looking down along the line 4—4 of FIG. 2.
Figure 5:
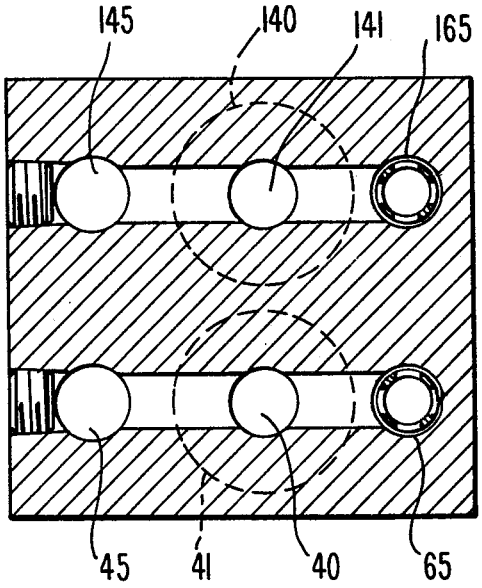
FIG. 5 is a view looking up along the line 5—5 of FIG. 2.

Prior to being operated manually, piston 20 of pump 10 will be in its upmost position and there is fluid communication between IN port 50 and OUT port 60 by way of passageway 25. Hcwever, there is insufficient pressure on port 99(*a*) of cylinder 99 (FIG. 6) to cause any movement of piston 199. When, at the conclusion of the last preceding manual operation, the maintenance man returned the pump handle to the position shown in solid lines so as to leave piston 20 in its upmost position, piston 20 was moved upwardly and, in so doing, air which had filled the piston chamber above the piston was forced out through passageway 81 and vent 82. Hcwever, since, as seen in FIG. 3, vent 82 is substantially smaller in cross sectional area than is passageway 81, a substantial amount of air pressure was applied by way of passageway 80 to the upper surface of the small lock-out piston 75, thereby forcing piston 75 downwardly and moving the poppet 70 out of its valve seat, thus opening the valve. This allowed low pressure hydraulic fluid from tank 94 to flow out of IN port 50 and into channel 45 and then by way of channel 42 and port 41 into the lower portion 40 of the piston chamber. Thus, at the start of the hand pump operation, the chamber 40 below piston 20 is filled with hydraulic fluid.

When the maintenance man pulls the pump handle 30 downwardly to lower the piston 20, air is drawn into the space above the piston through vent 82 and passageway 81 and since, as just described, vent 82 is of smaller cross sectional area than passageway 81, the space 80 above the small lock-out piston 75 is placed under substantially reduced pressure. Thus, the small lock-out piston 75 is pulled upwardly by the suction created in space 80 by the downward movement of piston 20. This seats poppet 70 in its valve seat and prevents fluid from the lower piston chamber 40 from being forced backward through port 41 and passageways 42 and 45 back into the IN port 50.

The pressure created by the just described manual downward stroke of piston 20 is sufficient to open check valve 65 and, accordingly, fluid flows from the lower piston chamber 40 out through port 41, passageway 46, check valve 65, passageway 66, OUT port 60 and through conduit 98 to port 99(a) of cylinder 99 thereby moving its piston 99 from left to right, and thereby changing the main valve V from open toward closed position. It will be understood, of course, that a number of down and up strokes of piston 20 will be necessary to fully close the main valve V. On each up stroke, lock-out piston 75 is pushed down by air pressure, thereby opening the poppet valve 70 and thereby allowing hydraulic fluid from tank 94 to flow into passage 45 and fill up the piston chamber 40 under the upwardly moving piston 20. On each down stroke, lock-out piston 75 is pulled up by suction, thereby closing the poppet valve 70. The downwardly moving piston 20 pressurizes the fluid in chamber 40, forcing it out passage 46, through check valve 65, and out OUT port 60 into conduit 98 leading to port 99(*a*) of cylinder 99, thereby moving the piston 199 from left to right.

Assume now that, while the operator is manually operating the hand pump 10, an electric signal is sent to the solenoid valve 102 to shift the valve from left to right, as viewed in FIG. 6. This applies high pressure gas from source 100 through check valve 101 and solenoid valve 102 into gas tank 93 of the gas-oil tank 93–94. High pressure oil is now applied through valve 95 and conduit 97 to IN port 50 of pump 10. Due to the fact that the undersurface of the small lockout piston 75 (FIG. 2) has a larger area than does the poppet 70, a diffential pressure is applied to the undersurface 76 of the lockout piston 75. This causes piston 75 to move upwardly, thereby seating the poppet 70 in its valve seat and closing the valve. This prevents the high pressure fluid from IN port 50 from entering passage 45, thereby preventing the high pressure fluid from entering the lower piston chamber 40.

Assume, at the instant that the high fluid pressure first appeared at the IN port 50, that the piston 20 was in its down stroke and passageway 25 was not interconnecting IN port 50 and OUT port 60. However, the seal between the cylindrical surface of the piston 20 and the wall of the piston chamber is not perfect and, as a result, high pressure hydraulic fluid passes around the cylindrical wall of piston 20 and into port 60 and passage 66 and is applied to the output side of check valve 65, which may preferably be a Kepsel cartridge type check valve, manufactured by Kepner Products Company, Summit, Illinois. This pressure may, where the supply at 100 is natural gas, be of the order of 1500 p.s.i., which is substantially greater than the pressure (approximately 250 p.s.i.) which is being developed manually by the hand pump and applied to the other side of the check valve. Thus, check valve 65 closes.

With poppet 70 closed, and with check valve 65 also closed, there is no place for the fluid in the lower part 40 of the piston chamber to go and, as a result, the operator is unable to complete manually the downward stroke of the piston 20. He is, however, able to pull the piston upwardly. When he does so, air in the piston chamber above the piston is pushed out through passageway 81 and through vent 82. However, as already explained, the cross-sectional area of vent 82 is much smaller than the cross-sectional area of passageway 81. Accordingly, a substantial increase in air pressure develops in passage 80 and is applied downwardly against the upper surface of the lockout piston 75. This air pressure is geater than the differential pressure developed by the high pressure hydraulic fluid on the undersurface of the piston 75. Thus, piston 75 is forced downwardly to slightly open the poppet 70. Ihis allows a limited amount of high pressure fluid to enter passageway 45 and to pass through passageway 42 and port 41 into the lower chamber 40 of the piston chamber, thereby allowing the maintenance man to slowly and safely move piston 20 to its full upright position. Just before piston 20 attains its upmost position, fluid communication is re-established between IN port 50 and OUT port 60 by way of interconnecting channel 25. The high pressure hydraulic fluid from gas-oil tank 93–94 is now applied directly from the IN port through the passageway 25 to the OUT port 60, and thence by way of conduit 98 to port 99(*a*) of cylinder 99. This moves the piston 199 from left to right, thereby changing the main valve V from open to closed position.

It is to be noted that, following arrival of high pressure fluid in IN port 50, poppet 70 remains closed, and that it is not until the maintenance man pulls the piston 20 upward that sufficient air pressure is applied to the upper surface of lockout piston 75 to overcome the differential pressure applied to the undersurface of the lock-out piston to move the lockout piston downward to open the poppet 70 slightly. It is to be noted that the lower chamber 40 is not pressurized to the same pressure as the high pressure fluid, but rather is only pressurized sufficiently to allow the piston 20 to be slowly and safely raised.

What is claimed is:

1. A remote control system for actuating a main valve wherein a selector valve controls the application of high pressure hydraulic fluid to a main valve actuator selectively through a first or second hand pump one of which is used to open the main valve and the other of which is used to close it, each of said hand pumps having a main piston chamber and a main piston in said chamber mounted for down and up strokes, the improvement which comprises the provision of the following:

a. an IN port in each of said hand pumps located at one side of said hand-pump main piston chamber;

b. means connecting said IN port to a source of hydraulic fluid which is either under very low pressure or under high pressure according to the position of said selector valve;

c. an OUT port in each of said hand pumps located at the other side of said hand-pump main piston chamber;

d. means connecting said OUT port to said main valve actuator;

e. a cross passageway providing hydraulic fluid communication across said hand-pump main piston between said IN port and said OUT port when said hand-pump main piston is in an upper position;

f. a first passageway located radially outward of said hand-pump main piston chamber for providing hydraulic fluid communication between the bottom of said hand-pump main piston chamber and said OUT port;

g. one-way means in said first passageway blocking hydraulic fluid flow from said OUT port to the bottom of said hand-pump main piston chamber;

h. a second passageway located radially outward of said hand-pump main piston chamber for providing hydraulic fluid communication between said IN port and the bottom of said hand-pump main piston chamber;

i. a valve seat and a poppet valve in said second passageway;

j. an air passageway located radially outwardly of said hand-pump main piston chamber and extending from the top of said hand-pump main piston chamber toward said IN port;

k. a small lock-out piston in said air passageway, said lock-out piston having a cross-sectional area corresponding to that of said air passageway in which it is located, said lock-out piston being connected by a shaft to said poppet valve;

l. the lower surface of said lock-out piston facing said IN port and being larger in area than the surface area of said poppet valve facing said valve seat, whereby when high pressure hydraulic fluid is applied to said IN port, a differential hydraulic pressure is applied to said lock-out piston sufficient to move said lock-out piston upwardly to seat and close said poppet valve, thereby to cut off fluid communication from said IN port to the bottom of said hand-pump main piston chamber.

2. Apparatus according to claim 1 wherein said IN port and said OUT port are located at an intermediate level with respect to the top and bottom of said hand-pump main piston chamber.

3. Apparatus according to claim 2 wherein said cross passageway is located in the lower portion of said hand-pump main piston.

4. Apparatus according to claim 3 wherein an air vent is provided in said air passageway above said lock-out piston.

5. Apparatus according to claim 4 wherein said air passageway includes a connection to the top of said hand-pump main piston chamber, said connection being substantially smaller in cross sectional area than the remainder of said air passageway, said connection being substantially larger in cross sectional area than said air vent wherein, when said hand-pump piston is pushed downwardly, a low-pressure area is created above said lock-out piston which pulls said lock-out piston up to seat and close said poppet valve, and wherein, when said hand-pump piston is pulled upwardly, an increase in air pressure occurs above said lock-out piston to push said lock-out piston down to open said poppet valve.

6. Apparatus according to claim 5 wherein the parameters are such that the air pressure developed during the up stroke of the hand-pump main piston and applied to the upper surface of the lock-out piston is larger than the differential pressure applied to the under-surface of the lock-out piston by the high pressure hydraulic fluid received at the IN port.

7. A manually operable hand pump, having a main piston chamber and a main piston in said chamber, comprising:

a. an IN port located at one side of said hand-pump main piston chamber for receiving hydraulic fluid;

b. an OUT port located at the other side of said hand-pump main piston chamber for discharging hydraulic fluid;

c. a cross passageway providing hydraulic fluid communication across said hand-pump main piston between said IN port and said OUT port when said hand-pump main piston is in an upper position;

d. a first passageway located radially outward of said hand-pump main piston chamber for providing hydraulic fluid communication between the bottom of said hand-pump main piston chamber and said OUT port;

e. one-way means in said first passageway blocking hydraulic fluid flow from said OUT port to the bottom of said hand-pump main piston chamber;

f. a second passageway located radially outward of said hand-pump main piston chamber for providing hydraulic fluid communication between said IN port and the bottom of said hand-pump main piston chamber;

g. a valve seat and a pcppet valve in said second passageway;

h. an air passageway located radially outwardly of said hand-pump main piston chamber and extending from the top of said hand-pump main piston chamber toward said IN port; and i. a small lock-out piston in said air passageway, said lock-out piston having a cross-sectional area corresponding to that of said air passageway in which it is located, said lock-out piston being connected by a shaft to said poppet valve.

8. Apparatus according to claim 7 wherein:

a. the lower surface of said lock-out piston facing said IN port is larger in area than the surface area of said poppet valve facing said valve seat, whereby when pressurized hydraulic fluid is applied to said IN port, a differential hydraulic pressure is applied to said lock-out piston sufficient to move said lock-out piston upwardly to seat and close said poppet valve, thereby to cut off fluid communication from said IN port to the bottom of said hand-pump main piston chamber.

9. Apparatus according to claim 7 wherein said IN port and said OUT port are located at an intermediate level with respect to the top and bottom of said hand-pump main piston chamber.

10. Apparatus according to claim 9 wherein said cross passageway is located in the lower portion of said hand-pump main piston.

11. Apparatus according to claim 7 wherein an air vent is provided in said air passageway above said lock-out piston.

12. Apparatus according to claim 11 wherein said air passageway includes a connection to the top of said hand-pump main piston chamber, said connection being substantially smaller in cross sectional area than the remainder of said air passageway, said connection being substantially larger in cross sectional area than said air vent wherein, when said hand-pump piston is pushed downwardly, a low-pressure area is created above said lock-out piston which pulls said lock-out piston up to seat and close said poppet valve, and wherein, when said hand-pump piston is pulled upwardly, an increase in air pressure occurs above said lock-out piston to push said lock-out piston down to open said poppet valve.

* * * * *